United States Patent [19]

Hartman et al.

[11] Patent Number: 4,552,680

[45] Date of Patent: Nov. 12, 1985

[54] HYPOCHLORITE BLEACH CONTAINING SURFACTANT AND ORGANIC ANTIFOAMANT

[75] Inventors: William L. Hartman; David A. O'Brien, both of Cincinnati; Thomas H. Taylor, Middletown, all of Ohio

[73] Assignee: The Procter & Gamble Company, Cincinnati, Ohio

[21] Appl. No.: 549,528

[22] Filed: Nov. 4, 1983

[51] Int. Cl.[4] ..... C11D 7/26; C11D 7/54

[52] U.S. Cl. ..... 252/102; 252/95; 252/174.11; 252/321; 252/358; 252/547

[58] Field of Search ..... 252/95, 98, 99, 102, 252/174.11, 187.25, 187.26, 321, 358, 547

[56] References Cited

U.S. PATENT DOCUMENTS

| | | | |
|---|---|---|---|
| 2,632,736 | 3/1953 | Currie | 252/358 |
| 3,328,306 | 6/1967 | Ellis | 252/99 |
| 3,518,201 | 6/1970 | Wessells | 252/99 |
| 3,684,722 | 8/1972 | Hyman et al. | 252/98 |
| 3,876,551 | 4/1975 | Laufer et al. | 252/99 |
| 4,071,463 | 1/1978 | Steinhauer | 252/103 |
| 4,080,180 | 3/1978 | Lyons | 44/77 |
| 4,113,645 | 9/1978 | DeSimone | 252/187 |
| 4,192,761 | 3/1980 | Peltre et al. | 252/99 |
| 4,287,079 | 9/1981 | Robinson | 252/99 |
| 4,287,080 | 9/1981 | Siklosi | 252/104 |
| 4,303,555 | 12/1981 | Boden et al. | 252/522 R |
| 4,390,448 | 6/1983 | Boden et al. | 252/187.26 |
| 4,469,848 | 9/1984 | Hooper et al. | 252/106 |

FOREIGN PATENT DOCUMENTS

| | | |
|---|---|---|
| 0021581 | 1/1981 | European Pat. Off. . |
| 74581 | 6/1975 | Japan . |
| 69415 | 6/1977 | Japan . |
| 429423 | 5/1935 | United Kingdom . |
| 886084 | 1/1962 | United Kingdom . |
| 1329086 | 9/1973 | United Kingdom . |
| 787060 | 12/1980 | U.S.S.R. . |

*Primary Examiner*—Prince E. Willis

*Attorney, Agent, or Firm*—Leonard Williamson; Ronald L. Hemingway; Richard C. Witte

[57] ABSTRACT

An improvement in hypochlorite bleach compositions which comprise selected hypochlorite stable surfactants and organic antifoamants.

5 Claims, No Drawings

HYPOCHLORITE BLEACH CONTAINING SURFACTANT AND ORGANIC ANTIFOAMANT

FIELD OF THE INVENTION

This invention relates to the preparation of hypochlorite bleach compositions containing surfactants and other additives.

In another respect it relates to the use of an antifoamant in such compositions to enhance fast line speed bottling and packing.

BACKGROUND

Aqueous bleach compositions containing alkali metal hypohalites, particularly sodium hypochlorite, have been known for many years. Because of their powerful oxidizing action they have also been acknowledged to be powerful stain removers and germicides and have been used extensively where this property is beneficial, in laundry bleaches, in the cleaning of baths, wash basins, flush toilets, drains and ceramic tile floors.

Selected surfactants such as amine oxides and alkyl phenoxy benzene disulphonates are known to be used in hypochlorite compositions for various purposes. They are used as foamers, solubilizers, thickeners and suspending agents. The drawback to such use in modern times in certain compositions is that these surfactants foam too much when packing, which slows down fast line speed bottling and packing rates.

The usefulness of organic antifoamants is believed to be new in the art of fast line speed packing of aqueous hypochlorite bleach compositions. However, some additives used in hypochlorite bleach compositions may contain small amounts of materials which could be useful as antifoamants if used at elevated levels. E.g., the antifoaming property of 2,6-dimethyl-2-octanol, a component of a perfume mixture, is not recognized in U.S. Pat. No. 3,876,551, to R. J. Laufer and J. H. Geiger, Jr., issued Apr. 8, 1975.

SUMMARY OF THE INVENTION

An aqueous laundry bleach composition comprising: from about 2% to about 16% by weight alkali metal hypochlorite compound; from about 0.05% by weight hypochlorite stable surfactant and a hypochlorite stable organic antifoamant at a level of from about 0.005% to about 1% by weight of said composition; wherein said organic antifoamant is present at a level in said composition which reduces foam at least 25% versus a comparable composition free of said organic antifoamant according to the Foam Reduction Test as defined herein; and wherein when said hypochlorite stable surfactant is an amine oxide said level of organic antifoamant is at least 0.05% by weight of said composition.

OBJECTS OF THE INVENTION

It is therefore an object of this invention to provide an antifoamant for surfactant containing aqueous hypochlorite bleach compositions.

Another object is to reduce the time needed to bottle and pack aqueous hypochlorite bleach compositions on fast lines.

Other objects of the present invention will be apparent in the light of this disclosure.

DETAILED DESCRIPTION OF THE INVENTION

This invention relates to an aqueous hypochlorite bleach composition comprising from about 2% to about 16% (preferably 5–6%) by weight alkali metal hypochlorite compound; from about 0.05% to about 3.0% (preferably 0.05–0.5%) by weight hypochlorite stable surfactant and a hypochlorite stable organic antifoamant at a level of from about 0.005% to about 1% (preferably 0.025–0.25%) by weight of said composition. It is important that the organic antifoamant is present at a level in said composition which reduces foam produced by the surfactant by at least 25% versus a comparable composition free of the organic antifoamant according to the Foam Reduction Test. When the hypochlorite stable surfactant is an amine oxide, the level of organic antifoamant is at least 0.05% by weight of the composition.

Alkali Metal Hypochlorites

Alkali metal hypochlorites are commercially available as aqueous solutions. The bulk suppliers can produce material having available chlorine contents from 2–16% by weight. These commercially available hypochlorite solutions contain other salts as by-products or contaminants, more specifically free alkalinity in the form of alkali metal hydroxide and alkali metal carbonate, and alkali metal chloride. In addition, other salts, most notably alkali metal chlorates, are often present in small quantities as a result of partial decomposition of the hypochlorite. The levels of the by-product materials depend on the processing conditions employed in the manufacture of the hypochlorite, but in general in household laundry bleaches containing 4–6% alkali metal hypochlorite, they fall within the ranges: 0.005–0.50% alkali metal hydroxide, 0.001–0.05% alkali metal carbonate, 3.0–5.0% alkali metal chloride.

The Organic Antifoamant

The present invention comprises from about 2% to about 16% by weight alkali metal hypochlorite compound; from about 0.05% to about 3.0% by weight hypochlorite stable surfactant and a hypochlorite stable organic antifoamant at a level of from about 0.005% to about 1% by weight of said composition. The organic antifoamant must be present at a level in said composition to reduce the foam created by the surfactant by at least 25% versus a comparable composition free of said organic antifoamant according to the Foam Reduction Test as described herein. When the hypochlorite stable surfactant is an amine oxide the level of the organic antifoamant is at least 0.05% by weight of said composition.

The preferred organic antifoamant is selected from the group consisting of:

(A) $C_6$–$C_{20}$ aliphatic tertiary alcohols having the following molecular structures:

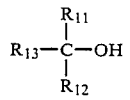

wherein $R_{11}$ is a $C_3$–$C_7$ straight chain, branched or cyclic saturated alkyl group and $R_{12}$ and $R_{13}$ are $C_1$–$C_{12}$ straight chain or branched saturated alkyl groups;

(B) $C_6$–$C_{20}$ aliphatic esters having the following molecular structures:

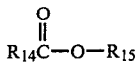

wherein $R_{14}$ is a $C_1$–$C_{18}$ straight chain, branched or cyclic saturated alkyl group and $R_{15}$ is a $C_1$–$C_{18}$ straight chain, branched or cyclic saturated alkyl group;

(C) $C_6$–$C_{20}$ aromatic esters and diesters having the following molecular structures:

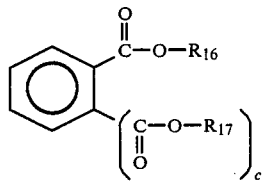

wherein $R_{16}$ and $R_{17}$ are $C_1$–$C_{12}$ straight chain, branched, or cyclic saturated alkyl groups, and c is 0 or 1;

(D) $C_6$–$C_{20}$ lactones having the structure:

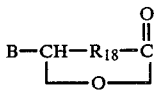

wherein $R_{18}$ is a $C_1$–$C_{16}$ straight chain or branched saturated alkyl group; and B is a hydrogen atom or $C_1$–$C_{16}$ straight chain or branched saturated alkyl group;

(E) $C_6$–$C_{20}$ acetals and $C_6$–$C_{20}$ ketals having the following molecular structures:

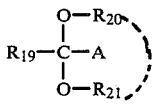

wherein $R_{19}$ is a $C_3$–$C_{16}$ straight chain, branched or cyclic saturated alkyl group or is a benzyl, alkylbenzyl, dialkylbenzyl, 2-phenylethyl, or naphthyl group; and $R_{20}$ and $R_{21}$ are separate $C_1$–$C_{12}$ straight chain or branched saturated alkyl chains or together complete a five membered ring by contributing two saturated carbon atoms and may or may not contain an alkyl substituent, and A is a hydrogen atom or a $C_1$–$C_8$ straight chain or branched saturated alkyl group;

(F) and mixtures thereof.

The organic antifoamant is preferably present at a level which reduces foam at least 70% versus a comparable composition free of said organic antifoamant according to the Foam Reduction Test. This is highly desirable when the surfactant level is from about 0.05% to 0.50% of the composition and the level of the organic antifoamant is from about 0.025% to about 0.25%.

A preferred embodiment of the present invention is where some or all of the organic antifoamant materials are also perfume ingredients. For example, the following organic antifoamant materials can also be used as perfume ingredients:

2,6-dimethyloctan-2-ol,
3,7-dimethyloctan-3-ol,
2,6-dimethylheptan-2-ol,
2,4,4-trimethylpentan-2-ol,
2,4,4,6,6-pentamethylheptan-2-ol,
1-methyl-4-isopropylcyclohexan-8-ol,
4-tertiarybutylcyclohexyl acetate,
4-tertiarypentylcyclohexyl acetate,
diethylphthalate,
phenylacetaldehyde dimethyl acetal, and
mixtures thereof.

The most preferred organic antifoamants of this invention can be used at a level in the composition of the present invention which reduces foam at least 90% versus a comparable composition free of said organic antifoamant according to the Foam Reduction Test.

The Surfactant

The surfactant can be used to dissolve or disperse additives such as the organic antifoamant, perfume or brighteners in the water medium.

The preferred surfactants are a coconut derived amine oxide, alkyl phenoxy benzene disulphonate, and linear alkylbenzene sulfonate (LAS). The preferred level of surfactant in the liquid bleach composition of this invention is about 0.05% to about 0.5%.

In accordance with the present invention the preferred compositions contain a surfactant which is selected from the group consisting of:

(A) linear alkylbenzene sulfonates having the following molecular structures:

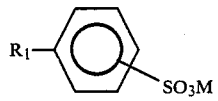

wherein $R_1$ is a $C_8$–$C_{20}$ saturated alkyl group and M is an alkali metal;

(B) linear alkyl sulfates having the structures:

$R_2OSO_3M$ wherein $R_2$ is a $C_8$–$C_{20}$ saturated alkyl group and M is an alkali metal;

(C) linear alkyl paraffin sulfonates:

$R_3SO_3M$ wherein $R_3$ is a $C_8$–$C_{20}$ saturated alkyl group and M is an alkali metal;

(D) mono- and di-alkyl diphenyl ether disulfonates having the following molecular structures:

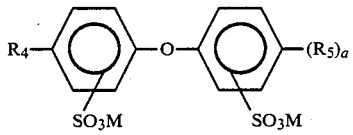

wherein $R_4$ and $R_5$ are $C_8$–$C_{15}$ saturated alkyl groups, M is alkali metal, and a is 0 or 1;

(E) tertiary amine oxides having the following molecular structures:

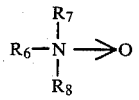

wherein $R_6$ is a $C_8$–$C_{18}$ saturated alkyl group; $R_7$ and $R_8$ are $C_1$–$C_{12}$ saturated alkyl groups;

(F) zwitterionic or amphoteric compounds having the following molecular structures:

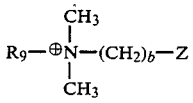

wherein $R_9$ is a $C_8$–$C_{18}$ linear or branched saturated alkyl group, b is 1–6, and Z is $—(CO_2)^-$ or $—(SO_3)^-$;

(G) fatty acid carboxylate soaps having the following molecular structures:

$R_{10}—CO_2M$ wherein $R_{10}$ is a $C_8$–$C_{20}$ saturated alkyl group and M is an alkali metal;

(H) and mixtures thereof.

A preferred embodiment of the present invention contains sodium hypochlorite at a level of from about 4% to about 9%, and most preferably from 5% to 6%. In such compositions the preferred surfactant is selected from the group consisting of:

(A) linear alkylbenzene sulfonates having the following molecular structures:

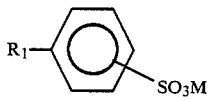

wherein $R_1$ is a $C_8$–$C_{20}$ saturated alkyl group and M is an alkali metal;

(B) mono- and di-alkyl diphenyl ether disulfonates having the following molecular structures:

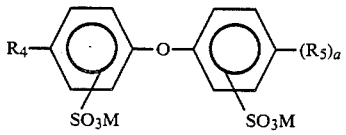

wherein $R_4$ and $R_5$ are $C_8$–$C_{15}$ saturated alkyl groups, M is alkali metal, and a is 0 or 1;

(C) tertiary amine oxides having the following molecular structures:

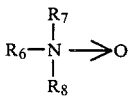

wherein $R_6$ is a $C_8$–$C_{18}$ saturated alkyl group; $R_7$ and $R_8$ are $C_1$–$C_{12}$ saturated alkyl groups;

(D) and mixtures thereof,

A highly preferred embodiment of the present invention in which the surfactant is a mixture of linear alkylbenzene sulfonates having molecular structures of:

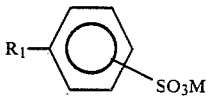

wherein $R_1$ is a $C_{10}$–$C_{15}$ saturated linear alkyl group, such that the mixture has an average $R_1$ chain length of 11 to 13 carbon atoms and M is sodium, the level of the organic antifoamant material or materials is preferably from about 0.06% to about 0.15% of the composition.

Another highly preferred surfactant is a mixture of mono- and/or di-alkyl diphenyl ether disulfonates having the following molecular structures:

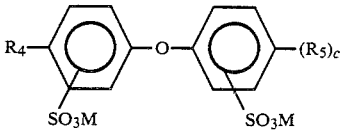

wherein $R_4$ and $R_5$ are $C_{10}$–$C_{12}$ alkyl groups, M is an alkali metal, and c is 0 or 1.

Yet another preferred surfactant is a mixture of tertiary amine oxides having the structures:

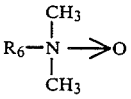

$R_6$ is a $C_{12}$–$C_{15}$ saturated alkyl group.

The Process for Fast Bottling and Packing

In another respect, the present invention is a process for fast line bottling and packing of an aqueous hypochlorite bleach composition containing a surfactant and an organic antifoamant.

Optional Ingredients

Optional ingredients which are not required for the practice of this invention, but may be components of compositions practiced herein include hypochlorite stable perfume materials, some or all of which may not be antifoamants, and hypochlorite stable optical brighteners (at a level of 0.025% to 0.1%) and other dyes.

Preferred brighteners have the following formulas:

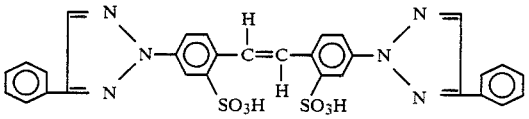

or the alkali metal salts thereof; or a hypochlorite stable optical brightener having the formula:

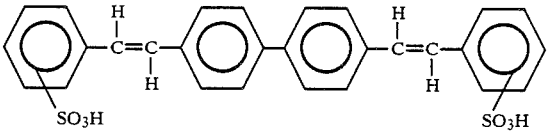

or the alkali metal salts thereof.

Foam Reduction Test

This test is designed to determine whether or not a hypochlorite stable organic material is also an antifoamant. The foam generated upon controlled agitation of a cylinder containing an aqueous alkali metal hypochlorite solution, a hypochlorite stable surfactant, and a hypochlorite stable organic additive is compared with the foam generated by a similar control composition free of the organic additive.

Foam/Liquid Ratio with Additive =

$$\frac{\text{Height of Foam Generated by Sample Containing Additive}}{\text{Height of Liquid in Same Sample Prior to Agitation}}$$

Foam/Liquid Ratio of Control =

$$\frac{\text{Height of Foam Generated by Control Sample}}{\text{Height of Liquid in Same Sample Prior to Agitation}}$$

Reduction of Foam Versus the Control =

$$\left(1 - \frac{\text{Foam/Liquid Ratio with Additive}}{\text{Foam/Liquid Ratio of Control}}\right) \times 100\%$$

The Foam Reduction Test procedure is set out in the following five steps:

1. At least two aliquots of 500 gms of sodium hypochlorite bleach solution (e.g., a 5.25% commercially available liquid bleach containing no additives) are each separately put into 1000 ml transparent plexiglass cylinders (of inside diameter 5 cm and height 65 cm). One cylinder is for a control.
2. To one of the above cylinders, add a measured amount of surfactant as an aqueous solution (e.g., 8.33 gms of 15% aqueous $C_{12}$LAS to produce a bleach composition containing about 0.25% LAS) and a measured amount of the organic additive to be tested as an antifoamant (e.g., 0.5 gms of diethyl phthalate to equal 0.1% of the total composition). To the control cylinder, add the same amount of type of the surfactant used above, but do not include the organic additive.
3. Record the height of liquid in each cylinder prior to agitation.
4. The cylinders are capped, mounted vertically on a wheel device which is driven by an electric motor, and rotated end over end about an axis passing through the midpoints of the cylinders. The cylinders are rotated simultaneously in this manner for 10 complete rotations at 24 rpm to produce foam.
5. After rotation, the solutions are allowed to stand for 60 seconds. The heights of the foam layers generated by each composition are measured. Values for Foam/Liquid Ratios and Reduction of Foam Versus the Control are calculated for the organic additive or additives tested.

An organic material is considered to be an antifoamant according to this invention if the reduction of foam versus the control is at least 25%. The organic material is a more preferred antifoamant if the reduction of foam is at least 50%, at least 70%, and most preferred if the foam reduction is at least 90%.

Hypochlorite Stability Tests

A. The Organic Antifoamant Stability Test

The definition of a "Hypochlorite Stable Organic Antifoamant" as used herein is an organic antifoamant, as defined herein, which is essentially unreactive in a composition containing about 2% to about 16% aqueous sodium hypochlorite having an initial pH of about 12 to 13 over a period of one month at 80° F. (27° C.), or preferably stable in a 5–6% aqueous sodium hypochlorite composition for 3 days at 120° F. (49° C.), as set out in the following test procedure:

1. Check the available chlorine of a 5–6% NaOCl solution and adjust the pH to 12.5 with NaOH or HCl.
2. Add 0.1% organic additive to a 50 ml aliquot of the base solution and shake using a glass bottle with a polyethylene lined lie or the like. Also prepare a control aliquot without the organic additive.
3. Age for 3 days at 120° F., or one month at 80° F., as the case may be.
4. Check for available chlorine. The organic additive is judged stable if the hypochlorite mixture retains 95% of the available chlorine as compared to the control aliquot which does not contain the organic additive.
5. If the organic additive is also a perfume material, it can be judged stable if it also retains its odor character.

B. Surfactant Stability Test

This test is performed the same as the Organic Antifoamant Stability Test, except that in Step 2, 0.5% surfactant is substituted for the organic material.

EXAMPLE 1

Eighteen samples of 500 gms each of Clorox®, a commercial sodium hypochlorite solution containing about 5.3% NaOCl, plus various amounts of inert ingredients were placed in the 1000 ml plexiglass cylinders described in the Foam Reduction Test. To each of these cylinders was added 8.33 gms of a 15% aqueous solution of Calsoft F-90®, a 90% active $C_{12}$ linear alkylbenzene sulfonate (LAS). This resulted in a composition containing 0.22% LAS. Six of the 18 samples were used as controls, to which no organic additives were introduced. To each of the remaining 12 samples, 0.5 gm of a different organic material was added to produce a composition containing 0.1% of the organic additive. All these organic additives were selected from groups of compounds which were judged to be stable in a sodium hypochlorite medium. The cylinders containing the samples were then rotated four at a time, and foam heights measured according to the procedure described in the Foam Reduction Test. These measurements, as well as the Reduction of Foam Versus the Control (average of the 6 control samples) are reported for each additive in Table 1.

TABLE 1

Foam Reduction Test Results

| Organic Additives Listed by Chemical Classes | Initial* Liquid Height in cm. | Foam Height in cm. | Foam/ Liquid Ratio | Reduction of Foam Versus Control |
|---|---|---|---|---|
| Tertiary Aliphatic Alcohols | | | | |
| 2,6-dimethyloctan-2-ol | 23.5 | 0.2 | 0.008 | 98% |
| 3,7-dimethyloctan-3-ol | 22.2 | 0.2 | 0.009 | 97% |
| 2,6-dimethylheptan-2-ol | 23.0 | 0.3 | 0.013 | 96% |
| t-butanol ($C_4$ compound) | 22.7 | 15.2 | 0.670 | −87% |
| Tertiary Aromatic Alcohols | | | | |
| dimethylbenzylcarbinol | 22.2 | 8.3 | 0.374 | −4% |
| dimethylphenylethylcarbinol | 23.5 | 7.0 | 0.298 | 17% |

TABLE 1-continued

Foam Reduction Test Results

| Organic Additives Listed by Chemical Classes | Initial* Liquid Height in cm. | Foam Height in cm. | Foam/ Liquid Ratio | Reduction of Foam Versus Control |
|---|---|---|---|---|
| Esters of Aliphatic Alcohols | | | | |
| 4-t-butylcyclohexyl acetate | 23.3 | 0.7 | 0.030 | 92% |
| 4-t-amylcyclohexyl acetate | 22.7 | 1.6 | 0.070 | 80% |
| diethylphthalate | 22.4 | 3.0 | 0.134 | 63% |
| 15-hydroxy-pentadecanoic acid lactone | 22.6 | 5.0 | 0.221 | 38% |
| Ester of Benzyl Alcohol | | | | |
| benzyl benzoate | 23.1 | 7.0 | 0.303 | 15% |
| Acetal | | | | |
| phenylacetaldehyde dimethyl acetal | 21.7 | 3.0 | 0.138 | 61% |
| Control (Avg. of 6) | 22.6 | 8.1 | 0.358 | — |

*Initial Liquid Heights vary slightly due to small differences in the inside diameters of the cylinders. The use of Foam/Liquid Ratios in the Reduction of Foam calculations should correct for these differences.

In this test and under these conditions, the tertiary aliphatic alcohols (except for the $C_4$ compound, i.e., the t-butanol), the esters of aliphatic alcohols (including the lactone), and the acetal, reduced foam relative to the control by greater than 25%, whereas the tertiary aromatic alcohols and benzyl alcohol ester did not.

EXAMPLE II

Nine samples of 500 gms each of Clorox ®, the commercial hypochlorite solution described in Example I, were placed in the plexiglass cylinders described in the Foam Reduction Test. To each of these cylinders was added 8.33 gms of 15% Calsoft F-90 ® LAS (described in Example I) to produce a composition containing 0.22% LAS. Three of the nine samples were used as controls to which no organic additive was introduced. To each of the remaining six samples, about 0.125 gm of a different organic material was added to produce a composition containing about 0.025% of the organic additive. All these organic additives were selected from groups of compounds which were judged to be stable in basic sodium hypochlorite and found to reduce foam by at least 25% when tested at a high level (0.1%) in Example I.

The cylinders containing the samples were then rotated, and the Reduction of Foam Versus the Control was calculated for each additive in accordance with the Foam Reduction Test. Results are reported in Table 2.

TABLE 2

Foam Reduction Test Results

| Organic Additives Listed by Chemical Classes | Initial* Liquid Height in cm. | Foam Height in cm. | Foam/ Liquid Ratio | Reduction of Foam Versus Control |
|---|---|---|---|---|
| Tertiary Aliphatic Alcohols | | | | |
| 2,6-dimethyloctan-2-ol | 23.3 | 3.5 | 0.150 | 61% |
| 3,7-dimethyloctan-3-ol | 22.1 | 3.0 | 0.136 | 64% |
| Esters of Aliphatic Alcohols | | | | |
| 4-t-butylcyclohexyl acetate | 23.4 | 2.0 | 0.085 | 78% |
| diethyl phthalate | 23.1 | 3.5 | 0.152 | 60% |
| 15-hydroxy-pentadecanoic acid lactone | 22.6 | 5.0 | 0.221 | 42% |
| Acetal | | | | |
| phenylacetaldehyde dimethyl acetal | 22.0 | 4.0 | 0.182 | 52% |

TABLE 2-continued

Foam Reduction Test Results

| Organic Additives Listed by Chemical Classes | Initial* Liquid Height in cm. | Foam Height in cm. | Foam/ Liquid Ratio | Reduction of Foam Versus Control |
|---|---|---|---|---|
| Control (Avg. of 3) | 22.3 | 8.5 | 0.382 | — |

*Initial Liquid Heights vary slightly due to small differences in the inside diameters of the cylinders. The use of Foam/Liquid Ratios in the Reduction of Foam calculations should correct for these differences.

In this example, all the organic materials tested reduced foaming to a sufficient extent to be classified as antifoamants according to the Foam Reduction Test. However, some of these organic materials (such as the tertiary alcohols) were markedly less efficient at foam reduction when used at the 0.025% level in this example when compared with Example I in which they were used at a higher level (0.10%). Therefore, for this particular surfactant system, 0.25% $C_{12}$ LAS, the higher level tertiary alcohol antifoamant as described in Example I, is preferred for foam reduction.

EXAMPLE III

Nine samples of 500 gms each of Clorox ®, the commercial sodium hypochlorite solution described in Example I, were placed in the plexiglass cylinders described in the Foam Reduction Test. To each of these cylinders was added 33.33 gms of 15% Calsoft F-90 ® LAS (described in Example I) to produce a composition containing 0.85% LAS. Three of the 9 samples were used as controls to which no organic additive was introduced. To each of the remaining 6 samples, about 0.5 gm of a different organic material was added to produce a composition containing about 0.1% of the organic additive. All these organic additives were selected from groups of compounds judged to be stable in basic sodium hypochlorite and found to reduce foam by at least 25% when tested against a lower level of LAS (0.22%) in Example I.

The cylinders containing these samples were then rotated, and the Reduction of Foam Versus the Control was calculated for each additive in accordance with the Foam Reduction Test. Results are reported in Table 3.

TABLE 3

Foam Reduction Test Results

| Organic Additives Listed by Chemical Classes | Initial* Liquid Height in cm. | Foam Height in cm. | Foam/ Liquid Ratio | Reduction of Foam Versus Control |
|---|---|---|---|---|
| Tertiary Aliphatic Alcohols | | | | |
| 2,6-dimethyloctan-2-ol | 23.5 | 4.5 | 0.192 | 77% |
| 3,7-dimethyloctan-3-ol | 22.5 | 3.0 | 0.133 | 84% |
| Esters of Aliphatic Alcohols | | | | |
| 4-t-butylcyclohexyl acetate | 23.5 | 4.0 | 0.170 | 80% |
| diethylphthalate | 22.0 | 7.0 | 0.318 | 63% |
| 15-hydroxy-pentadecanoic acid lactone | 23.4 | 6.5 | 0.278 | 67% |
| Acetal | | | | |
| phenylacetaldehyde dimethyl acetal | 21.6 | 5.5 | 0.255 | 70% |
| Control (Avg. of 3) | 21.8 | 18.5 | 0.849 | — |

*Initial Liquid Heights vary slightly due to small differences in the inside diameters of the cylinders. The use of Foam/Liquid Ratios in the Reduction of Foam calculations should correct for these differences.

EXAMPLE IV

Twelve samples of 500 gms each of Clorox®, the commercial sodium hypochlorite solution described in Example I, were placed in the plexiglass cylinders described in the Foam Reduction Test. To each of these cylinders was added 16.67 gms of Synprolam35DMO®, a commercial aqueous solution containing 30% of a mixture of alkyl dimethyl amine oxides (70% $C_{13}$ and 30% $C_{15}$). This resulted in a composition containing about 1.00% of the amine oxides. One of the 12 samples was used as a control to which no organic additive was introduced. To each of the remaining 11 samples, about 0.50 gm of a different organic material was added to produce a composition containing about 0.1% of the organic additive. All these organic additives were selected from groups of compounds which were judged to be stable in basic sodium hypochlorite.

The cylinders containing these samples were then rotated, and the Reduction of Foam Versus the Control was calculated for each additive in accordance with the Foam Reduction Test. Results are reported in Table 4.

TABLE 4

Foam Reduction Test Results

| Organic Additives Listed by Chemical Classes | Initial* Liquid Height in cm. | Foam Height in cm. | Foam/ Liquid Ratio | Reduction of Foam Versus Control |
|---|---|---|---|---|
| Tertiary Aliphatic Alcohols | | | | |
| 2,6-dimethyloctan-2-ol | 23.8 | 22.2 | 0.933 | 48% |
| 3,7-dimethyloctan-3-ol | 22.2 | 22.2 | 1.000 | 45% |
| 2,6-dimethylheptan-2-ol | 23.5 | 20.3 | 0.864 | 52% |
| Aromatic Alcohols | | | | |
| dimethylbenzylcarbinol | 22.5 | 27.3 | 1.213 | 33% |
| dimethylphenylethylcarbinol | 22.2 | 24.1 | 1.086 | 40% |
| methylphenyl carbinol | 22.5 | 35.6 | 1.582 | 12% |
| Esters of Aliphatic Alcohols | | | | |
| 4-t-butylcyclohexyl acetate | 22.2 | 36.2 | 1.631 | 10% |
| 4-t-pentylcyclohexyl acetate | 22.5 | 36.2 | 1.413 | 22% |
| diethylphthalate | 22.5 | 24.8 | 1.107 | 39% |
| 15-hydroxy-pentadecanoic acid lactone | 23.0 | 31.8 | 1.383 | 23% |
| Acetal | | | | |
| phenylacetaldehyde dimethyl acetal | 23.5 | 27.3 | 1.162 | 36% |
| Control | 22.5 | 40.6 | 1.803 | — |

*Initial Liquid Heights vary slightly due to small differences in the inside diameters of the cylinders. The use of Foam/Liquid Ratios in the Reduction of Foam calculations should correct for these differences.

EXAMPLE V

Three samples of 500 gms each of Clorox®, the commercial sodium hypochlorite solution described in Example I, were placed in the plexiglass cylinders described in the Foam Reduction Test. To each of these cylinders was added 33.33 gms of Synprolam35DMO®, a commercial aqueous solution containing 30% of a mixture of alkyl dimethyl amine oxides (70% $C_{13}$ and 30% $C_{15}$). This resulted in a composition containing about 2.00% of the amine oxides. One of the 3 samples was used as a control to which no organic additive was introduced. To each of the remaining 2 samples, about 0.50 gm of a different organic material was added to produce a composition containing about 0.1% of the organic additive. All these organic additives were selected from groups of compounds which were judged to be stable in basic sodium hypochlorite.

The cylinders containing these samples were then rotated, and the Reduction of Foam Versus the Control was calculated for each additive in accordance with the Foam Reduction Test. Results are reported in Table 5.

TABLE 5

Foam Reduction Test Results

| Organic Additives Listed by Chemical Classes | Initial* Liquid Height in cm. | Foam Height in cm. | Foam/ Liquid Ratio | Reduction of Foam Versus Control |
|---|---|---|---|---|
| Tertiary Aliphatic Alcohols | | | | |
| 2,6-dimethyloctan-2-ol | 22.2 | 25.4 | 1.144 | ≧38% |
| 3,7-dimethyloctan-3-ol | 24.0 | 26.0 | 1.083 | ≧41% |
| Control | 22.5 | 41.3** | 1.836 | — |

*Initial Liquid Heights vary slightly due to small differences in the inside diameters of the cylinders. The use of Foam/Liquid Ratios in the Reduction of Foam calculations should correct for these differences.

**At this point, foam had filled the entire cylinder cavity up to the stopper. Therefore, Reductions of Foam based on this control are reported as being "greater than or equal to" the calculated values.

EXAMPLE VI

Nine samples of 500 gms each of Clorox®, the commercial sodium hypochlorite solution described in Example I, were placed in the plexiglass cylinders described in the Foam Reduction Test. To each of these cylinders was added 1.67 gms of Synprolam35DMO®, a commercial aqueous solution containing 30% of a mixture of alkyl dimethyl amine oxides (70% $C_{13}$ and 30% $C_{15}$). This resulted in a composition containing about 0.1% of the amine oxides. Three of the 9 samples were used as controls to which no organic additive was introduced. To each of the remaining 6 samples, about 0.50 gm of a different organic material was added to produce a composition containing about 0.1% of the organic additive. All these organic additives were selected from groups of compounds which were judged to be stable in basic sodium hypochlorite.

The cylinders containing these samples were then rotated, and the Reduction of Foam Versus the Control was calculated for each additive in accordance with the Foam Reduction Test. Results are reported in Table 6.

TABLE 6

Foam Reduction Test Results

| Organic Additives Listed by Chemical Classes | Initial* Liquid Height in cm. | Foam Height in cm. | Foam/ Liquid Ratio | Reduction of Foam Versus Control |
|---|---|---|---|---|
| Tertiary Aliphatic Alcohols | | | | |
| 2,6-dimethyloctan-2-ol | 22.4 | 5.9 | 0.263 | 78% |
| 3,7-dimethyloctan-3-ol | 23.2 | 3.8 | 0.164 | 86% |
| Tertiary Aromatic Alcohols | | | | |
| methylphenyl carbinol | 22.4 | 26.0 | 1.161 | 4% |
| Esters of Aliphatic Alcohols | | | | |
| 4-t-butylcyclohexyl acetate | 22.9 | 21.6 | 0.943 | 22% |
| 15-hydroxy-pentadecanoic acid lactone | 22.7 | 20.3 | 0.894 | 26% |
| Acetal | | | | |
| phenylacetaldehyde dimethyl acetal | 23.5 | 18.4 | 0.783 | 35% |
| Control (Avg. of 3) | 22.6 | 27.3 | 1.206 | — |

*Initial Liquid Heights vary slightly due to small differences in the inside diameters of the cylinders. The use of Foam/Liquid Ratios in the Reduction of Foam calculations should correct for these differences.

EXAMPLE VII

Six samples of 500 gms each of Clorox®, the commercial sodium hypochlorite solution described in Example I, were placed in the plexiglass cylinders described in the Foam Reduction Test. To each of these cylinders was added the perfume material, tetrahydromuguol, in the amounts shown below in Table 7. Tetrahydromuguol is a mixture consisting primarily of 2,6-dimethyloctan-2-ol and 3,7-dimethyloctan-3-ol, with a smaller amount of 1-methyl-4-isopropylcyclohexan-8-ol. Various amounts of Calsoft F-90® or Synprolam-35DMO® were added to each sample to produce the levels of $C_{12}$ LAS or $C_{13}$–$C_{15}$ amine oxides shown in Table 7.

The cylinders containing these samples were then rotated, and the Reduction of Foam Versus the Control was calculated for each sample in accordance with the Foam Reduction Test using the controls containing each surfactant system alone found in Examples I through VI. Results are reported in Table 7.

TABLE 7

| Organic Additive and Surfactant | Foam Reduction Test Results: Initial* Liquid Height in cm. | Foam Height in cm. | Foam/Liquid Ratio | Source of Control | Reduction of Foam Versus Control |
|---|---|---|---|---|---|
| 0.10% tetrahydromuguol + 0.22% $C_{12}$ LAS | 22.5 | 0.2 | 0.009 | Example 1 | 97% |
| 0.025% tetrahydromuguol + 0.22% $C_{12}$ LAS | 22.2 | 3.0 | 0.135 | Example 2 | 52% |
| 0.10% tetrahydromuguol + 0.85% $C_{12}$ LAS | 22.5 | 4.0 | 0.178 | Example 3 | 79% |
| 0.10% tetrahydromuguol + 1.0% $C_{13}$–$C_{15}$ amine oxide | 22.5 | 21.6 | 0.960 | Example 4 | 48% |
| 0.10% tetrahydromuguol + 2.0% $C_{13}$–$C_{15}$ amine oxide | 22.9 | 21.6 | 0.943 | Example 5 | >49% |
| 0.10% tetrahydromuguol + 0.01% $C_{13}$–$C_{15}$ amine oxide | 22.7 | 6.4 | 0.280 | Example 6 | 77% |

*Initial Liquid Heights vary slightly due to small differences in the inside diameters of the cylinders. The use of Foam/Liquid Ratios in the Reduction of Foam calculations should correct for these differences.

What is claimed is:

1. A method of reducing foam in a process for fast line bottling and packing of a fragranced aqueous bleach composition from about 2% to about 16% by weight alkali metal hypochlorite compound and from about 0.05% to about 3.0% by weight hypochlorite stable surfactant, said method comprising adding to said composition a hypochlorite stable organic antifoamant at a level of from about 0.005% at about 1% by weight of said composition and wherein said organic antifoamant is present at a level in said composition which reduces foam at least 25% versus a comparable composition free of said organic antifoamant according to the Foam Reduction Test; and wherein when said hypochlorite stable surfactant is an amine oxide said level of organic antifoamant is at least 0.05% by weight of said composition, wherein said antifoamant material provides sufficient reduction of foam to facilitate faster packing line speeds in the bottling of said bleach.

2. The method of claim 1 wherein said surfactant is selected from the group consisting of:

(A) linear alkylbenzene sulfonates having the following molecular structures:

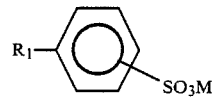

wherein $R_1$ is a $C_8$–$C_{20}$ saturated alkyl group and M is an alkali metal;

(B) linear alkyl sulfates having the structures:

$R_2OSO_3M$ wherein $R_2$ is a $C_8$–$C_{20}$ saturated alkyl group and M is an alkali metal;

(C) linear alkyl paraffin sulfonates:

$R_3SO_3M$ wherein $R_3$ is a $C_8$–$C_{20}$ saturated alkyl group and M is an alkali metal;

(D) mono- and di-alkyl diphenyl ether disulfonates having the following molecular structures:

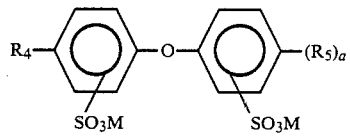

wherein $R_4$ and $R_5$ are $C_8$–$C_{15}$ saturated alkyl groups, M is alkali metal, and a is 0 or 1;

(E) tertiary amine oxides having the following molecular structures:

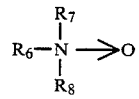

wherein $R_6$ is a $C_8$–$C_{18}$ saturated alkyl group; $R_7$ and $R_8$ are $C_1$–$C_{12}$ saturated alkyl groups;

(R) zwitterionic or amphoteric compounds having the following molecular structures:

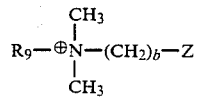

wherein $R_9$ is a $C_8$–$C_{18}$ linear or branched saturated alkyl group, b is 0–6, and Z is $—(CO_2)^-$ or $—(SO_3)^-$;

(G) fatty acid carboxylate soaps having the following molecular structures:

$R_{10}—CO_2M$ wherein $R_{10}$ is a $C_8$–$C_{20}$ saturated alkyl group and M is an alkali metal;

(H) and mixtures thereof; and wherein said organic antifoamant is selected from the group consisting of:

(A) $C_6$–$C_{20}$ aliphatic tertiary alcohols having the following molecular structures:

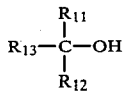

wherein $R_{11}$ is a $C_3$–$C_{17}$ straight chain, branched or cyclic saturated alkyl group and $R_{12}$ and $R_{13}$ are $C_1$–$C_{12}$ straight chain or branched saturated alkyl groups;

(B) $C_6$–$C_{20}$ aliphatic esters having the following molecular structures:

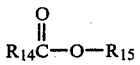

wherein $R_{14}$ is a $C_1$–$C_{18}$ straight chain, branched or cyclic saturated alkyl group and $R_{15}$ is a $C_1$–$C_{18}$ straight chain, branched or cyclic saturated alkyl group;

(C) $C_6$–$C_{20}$ aromatic esters and diesters having the following molecular structures:

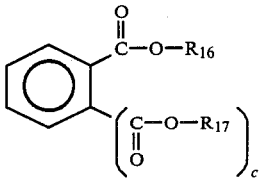

wherein $R_{16}$ and $R_{17}$ are $C_1$–$C_{12}$ straight chain, branched, or cyclic saturated alkyl groups, and c is 0 or 1;

(D) $C_6$–$C_{20}$ lactones having the structure:

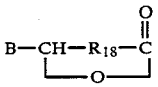

wherein $R_{18}$ is a $C_1$–$C_{16}$ straight chain or branched saturated alkyl group, and B is a hydrogen atom or $C_1$–$C_{16}$ straight chain or branched saturated alkyl group;

(E) $C_6$–$C_{20}$ acetals and $C_6$–$C_{20}$ ketals having the following molecular structures:

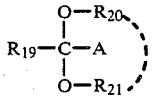

wherein $R_{19}$ is a $C_3$–$C_{16}$ straight chain, branched or cyclic saturated alkyl group or is a benzyl, alkylbenzyl, dialkylbenzyl, 2-phenylethyl, or naphthyl group; and $R_{20}$ and $R_{21}$ are separate $C_1$–$C_{12}$ straight chain or branched saturated alkyl chains or together complete a five-membered ring by contributing two saturated carbon atoms and may or may not contain an alkyl substituent, and A is a hydrogen atom or a $C_1$–$C_8$ straight chain or branched saturated alkyl group;

(F) and mixtures thereof.

3. The method of claim 2 wherein said organic antifoamant is present at a level which reduces foam at least 50% according to the Foam Reduction Test.

4. The method of claim 3 wherein said level of foam reduction is at least 70%.

5. The method of claim 4 wherein said level of foam reduction is at least 90%.

* * * * *

UNITED STATES PATENT OFFICE

CERTIFICATE OF CORRECTION

PATENT NO. : 4,552,680

DATED : November 12, 1985

INVENTOR(S) : William L. Hartman; David A. O'Brien & Thomas H. Taylor

It is certified that error appears in the above-identified patent and that said Letters Patent are hereby corrected as shown below:

Col. 1, line 20, after "beneficial," insert -- e.g., --.

Col. 1, line 47, after "0.05%" insert -- to about 3.0% --.

Col. 2, line 66, "$C_3$-$C_7$" should be -- $C_3$-$C_{17}$ --.

Col. 7, line 41, "amount of" should read -- amount and --.

IN THE CLAIMS:

Col. 13, line 53, after "composition" and before "from" insert -- containing --.

Signed and Sealed this

*Twenty-second* Day of *April 1986*

[SEAL]

*Attest:*

DONALD J. QUIGG

*Attesting Officer*

*Commissioner of Patents and Trademarks*